US009517643B2

(12) United States Patent
Shinagawa

(10) Patent No.: US 9,517,643 B2
(45) Date of Patent: Dec. 13, 2016

(54) RECORDING DEVICE AND CONTROL METHOD THEREFOR

(71) Applicant: Seiko Epson Corporation, Tokyo (JP)

(72) Inventor: Hiroki Shinagawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/931,214

(22) Filed: Nov. 3, 2015

(65) Prior Publication Data

US 2016/0136972 A1 May 19, 2016

(30) Foreign Application Priority Data

Nov. 13, 2014 (JP) ..... 2014-230437

(51) Int. Cl.

| | |
|---|---|
| ***B41J 29/38*** | (2006.01) |
| ***B41J 23/00*** | (2006.01) |
| ***B41J 2/01*** | (2006.01) |
| ***B41J 11/00*** | (2006.01) |

(52) U.S. Cl.
CPC ..... *B41J 11/006* (2013.01)

(58) Field of Classification Search
CPC ..... B41J 11/006; B41J 19/202
USPC ..... 347/16, 37, 104
See application file for complete search history.

(56) References Cited

U.S. PATENT DOCUMENTS

2009/0028586 A1 1/2009 Yamashiro et al.
2012/0007904 A1* 1/2012 Anzai ..... B41J 11/006 347/9

FOREIGN PATENT DOCUMENTS

CN 101352976 A 1/2009
JP 2013-180450 A 9/2013

* cited by examiner

*Primary Examiner* — Jannelle M Lebron

(57) ABSTRACT

When a paper jam occurs while printing, the control unit of a printer 1 retracts the head carriage 59 at a slow speed (initial retraction speed V1), and retracts the head carriage 59 at the slow speed to the target retraction position if the access cover 11 is not opened. If the access cover 11 is opened during retraction, the speed of head carriage 59 movement is changed to a faster retraction speed (high retraction speed V2). If the head carriage 59 is retracted quickly when the access cover 11 is opened, there is little chance of a user that wants to quickly restore printer 1 operation catching the stuck paper P on the printhead 22 and tearing the paper P. There is therefore little chance of problems resulting from torn pieces of paper being left inside the printer 1.

5 Claims, 8 Drawing Sheets

RECORDING DEVICE AND CONTROL METHOD THEREFOR

BACKGROUND

1. Technical Field

The present invention relates to a recording device that holds and conveys recording paper or other medium with a pair of conveyance rollers and records on the medium being conveyed with a recording head, and moves the recording head between a position opposing the medium and a position retracted from above the medium, and to a control method of the recording device.

2. Related Art

Recording devices such as inkjet printers have a conveyance mechanism comprising a conveyance roller pair that holds and conveys recording paper (media) between a driven roller and a conveyance roller, which is the drive roller, and a recording head that prints (records) by ejecting ink onto the recording paper being conveyed. Some such recording devices move a carriage that carries the recording head in a direction crosswise to the conveyance direction of the recording paper, and move the recording head between a position (recording position) opposing the recording paper on the conveyance path and a position (retracted position) removed to the side (widthwise) away from the conveyance path. When not printing, the recording head is moved to the retracted position where it waits.

Some such recording devices have a cover disposed to the outside case of the recording device, and when a paper jam occurs with the conveyed recording paper stuck in the conveyance path, the cover can be opened to expose the conveyance path and remove the jammed recording paper. An example of such a recording device (image forming device) is described in JP-A-2013-180450. The image forming device described in JP-A-2013-180450 has an openable access cover disposed to the front of the device cabinet. This image forming device detects when the user opens the cover and retracts the recording head to a position removed from the conveyance path to open the conveyance path of the recording paper (medium). Because one roller of the conveyance roller pair is disposed to the cover, opening the cover also releases the recording paper from being nipped by the conveyance roller pair. The recording paper can therefore be easily removed from the conveyance path.

If the recording head is retracted from the conveyance path to open the conveyance path as described in JP-A-2013-180450, there is a chance of the moving recording head or carriage catching and pulling the recording paper stuck in the conveyance path, making the paper jam worse, damaging the paper, and making completely removing the jammed paper more difficult. When retracting the recording head from the conveyance path when a paper jam occurs, the carriage is therefore controlled to move at a slower speed than when printing.

However, the time required to completely retract the recording head obviously increases if the distance the carriage must travel is great when the carriage is retracted at a slow speed. Therefore, if the user opens the cover before head retraction is completed in order to quickly remove the paper jam and resume operation, the user may pull the jammed recording paper while the recording head is still positioned over the recording paper, and the recording paper may catch on the recording head or carriage and be torn. Pieces of the torn recording paper may therefore be left inside the recording device and create other problems.

To avoid such problems, the recording head and carriage are preferably retracted quickly from the conveyance path when the cover is opened. However, the literature is silent about retracting the recording head appropriately according to operation of the cover.

SUMMARY

A recording device and a control method therefor according to the invention enable retracting the recording head appropriately to operation of the cover that opens and closes the conveyance path while minimizing the chance of the paper jam being made worse by retracting the recording head when a paper jam occurs, and thereby reduce the chance of further problems being caused by pieces of paper being left inside the recording device.

A recording device according to one aspect of the invention has a conveyance roller pair that conveys a recording medium; a recording head that records on the recording medium; a carriage that carries the recording head; a carriage drive mechanism that moves the carriage crosswise to the conveyance direction of the recording medium; a control unit that, when a paper jam of the recording medium is detected, retracts the carriage to one end or the other end of the carriage movement range at a predetermined initial retraction speed; an access cover that covers the conveyance path through which the recording medium is conveyed; and a detector that detects opening the access cover. The control unit changes the speed of carriage movement to a faster speed than the initial retraction speed based on the detector detecting opening of the access cover.

Another aspect of the invention is a control method of a recording device that sets a recording head opposite a recording medium conveyed by a conveyance roller pair, records on the recording medium, and when a paper jam of the recording medium is detected, retracts a carriage carrying the recording head to one side or the other side of a direction crosswise to the conveyance direction of the recording medium, the control method including: a first step of starting retraction at a predetermined initial retraction speed when a paper jam of the recording medium is detected; a second step of changing the speed of carriage movement to a faster speed than the initial retraction speed if opening of an access cover that covers the conveyance path through which the recording medium is conveyed is detected; and a third step of opening the conveyance roller pair after the recording head reaches a position separated from the recording medium.

A recording device and control method therefor according to the invention thus move the carriage carrying the recording head to a position separated from the recording medium when a paper jam occurs, and makes removing the stuck recording medium easy. Movement of the carriage for retraction starts at a predetermined initial retraction speed, and the speed of carriage retraction increases only if opening an access cover of the device case is detected while retracting the carriage. As a result, because the initial retraction speed is slow, the carriage is retracted at a slow speed unless the access cover is opened by the user, there is little chance of the moving head carriage or printhead catching and pulling the paper in the direction of travel and worsening the paper jam.

Because the head carriage is retracted at a high speed if the access cover is opened by the user, there is also little chance of a user that cannot wait for retraction to end pulling on the paper and the paper catching on the printhead or head carriage and tearing before the head carriage is completely retracted. There is therefore also little chance of problems resulting from torn pieces of paper being left inside the printer.

In a recording device and control method according to another aspect of the invention, one end of the carriage movement range is preferably a position further removed from the recording medium than a position where the recording head is removed from the recording medium; and when moving the carriage toward the one end for carriage retraction, the timing of opening the conveyance roller pair changes according to whether or not the detector detects opening of the access cover.

For example, if the detector detects opening of the access cover, the conveyance roller pair is preferably opened timed to the recording head reaching a first retracted position separated from the recording medium on the same side as the one end if the detector detects opening of the access cover, and if the detector does not detect opening of the access cover, the conveyance roller pair is preferably opened timed to the recording head passing the first retracted position and reaching the one end.

The invention makes removing jammed paper easy by retracting the recording head from over the paper and opening the conveyance roller pair, and preferably quickly creates this condition enabling easily removing the paper if the access cover is opened. However, if the conveyance roller pair is opened before the recording head is retracted from over the paper, the paper can easily separate from the platen and catch on the recording head, and the paper jam may be made worse. Therefore, if the access cover opens, the conveyance roller pair is opened as soon as the recording head moves away from the paper (as soon as the recording head reaches the first retracted position) without waiting for the recording head to separate completely from the recording medium. As a result, stuck recording media can be easily removed as soon as possible, and the chance of the recording medium being torn can be reduced.

Further preferably in a recording device and control method according to another aspect of the invention, the carriage movement range includes the one end, and a second retracted position where the recording head is separated from the recording medium on the opposite side as the one end; and when moving the carriage toward the opposite side as the one end when retracting the carriage, the control unit opens the conveyance roller pair timed to the recording head reaching the second retracted position whether or not the detector detects opening of the access cover.

Thus comprised, stuck recording media can be easily removed as soon as possible even when the carriage is retracted to the opposite side as the maintenance unit.

In a recording device according to another aspect of the invention, the recording head is preferably an inkjet head; and the one end of the carriage movement range is a position where the inkjet head opposes a head cap that caps the nozzle face of the inkjet head.

Thus comprised, when a paper jam occurs, the inkjet head can be retracted to a position where the nozzle face can be covered with a head cap.

A control method of a recording device according to another aspect of the invention preferably also includes monitoring at least one of the conveyance load of the recording medium, output from a sensor that detects the recording medium, and the drive load of the carriage; and detects a paper jam of the recording medium based on at least one of the conveyance load, the output, and the drive load.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures. An embodiment of the invention applied to a printer with an inkjet head is described below. The invention can also be applied to other types of recording devices having an inkjet head. The invention can also be applied to recording devices having a recording head other than an inkjet head.

General Configuration

Figure 1:
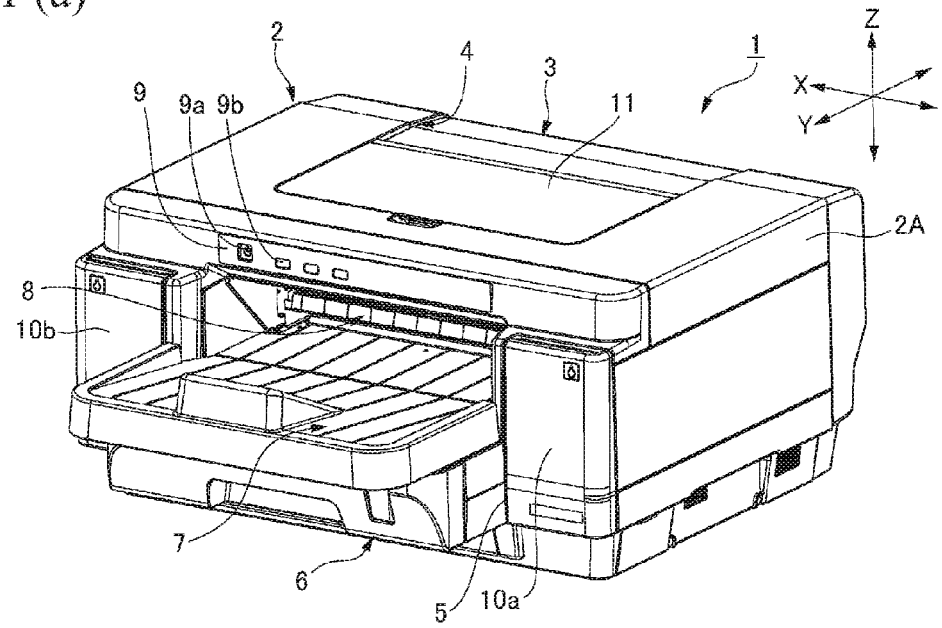
FIG. 1 is an oblique view of a printer.
Figure 1:
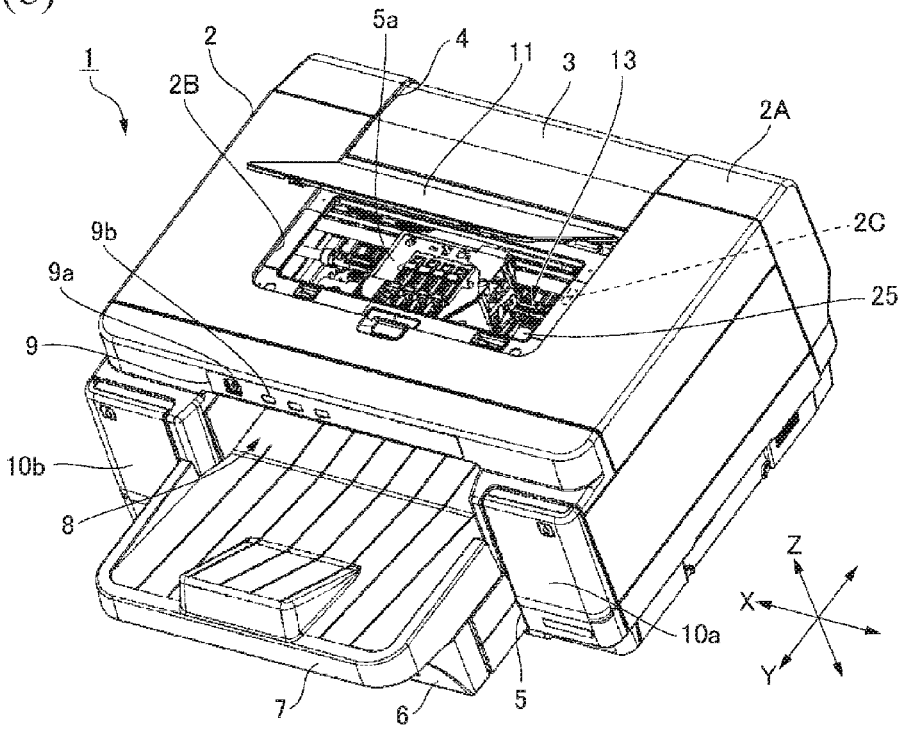
Figure 2:
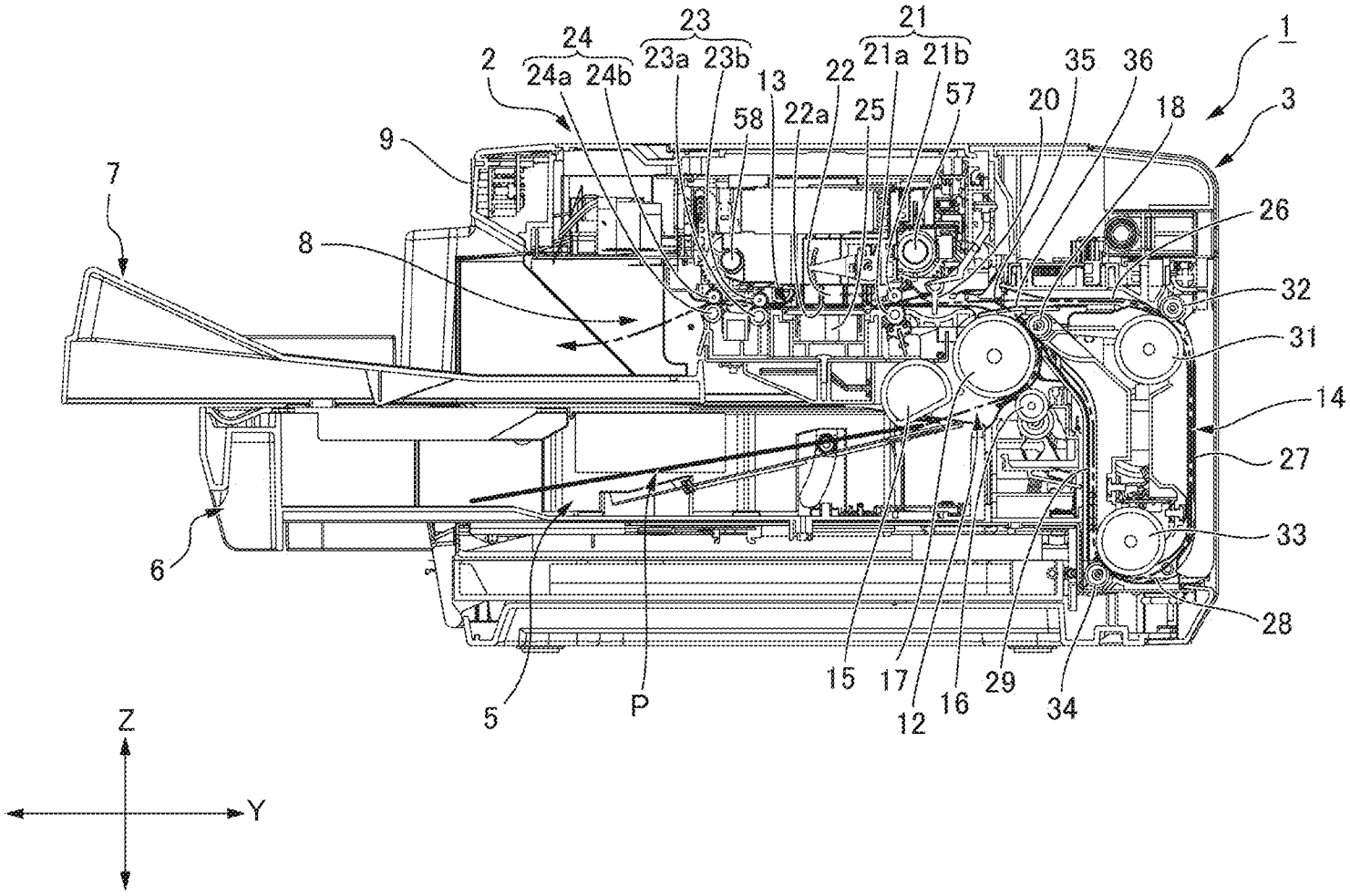
FIG. 2 is a vertical section view of the printer.

FIG. 1 is an external oblique view from the front of an inkjet printer ("printer" below) according to this embodiment of the invention, FIG. 1(*a*) showing the printer with the access cover closed, and FIG. 1(*b*) showing the printer with the access cover open. FIG. 2 is a vertical section view of the internal configuration of the printer. In the accompanying figures, the direction across the width of the printer is referred to as the transverse axis X, the direction between the front and back of the printer is the longitudinal axis Y, and the direction perpendicular to the transverse axis X and longitudinal axis Y is the vertical axis Z. Note that the X, Y, and Z axes are mutually perpendicular.

As shown in FIG. 1 and FIG. 2, the printer 1 (recording device) has a printer cabinet 2 and a reversing unit 3. The printer cabinet 2 includes a main case 2A with a basically rectangular box-like shape that is long on the transverse axis X. A recess 4 is formed in the middle of the back of the printer cabinet 2, and the reversing unit 3 is installed in this recess 4.

The reversing unit 3 is a unit for reversing the front and back sides of the printing paper P ("paper" below), which is a sheet recording medium, and then returning the reversed paper into the printer cabinet 2. The reversing unit 3 can pivot at the bottom of the printer on the vertical axis Z to open to the back of the printer on the longitudinal axis Y.

A paper cassette loading unit 5 is disposed to the front of the printer cabinet 2, and a paper cassette 6 can be removably installed from the front into the paper cassette loading unit 5. A paper discharge tray 7 is disposed above the paper cassette loading unit 5. A paper exit 8 is formed above the paper discharge tray 7.

An operating panel 9 is disposed the front of the printer above the paper exit 8, and includes a power switch 9*a* and a plurality of state indicators 9*b*.

Rectangular access doors 10*a*, 10*b* are attached to the front of the printer on opposite sides of the paper discharge tray 7 and paper exit 8. Opening the access doors 10*a*, 10*b* opens an ink cartridge loading unit (not shown in the figure) opens and ink cartridges (not shown in the figure) can be installed or replaced.

An access cover 11 for maintenance is attached to the top of the printer cabinet 2 in the middle. The access cover 11 opens and closes an opening 2B formed in the main case 2A. When the access cover 11 opens, the media conveyance path inside the printer (referred to below as the device-side conveyance path 13) is exposed as shown in FIG. 1(*b*). The paper P is printed on by the printhead 22 as it passes below the opening 2B, and is discharged from the paper exit 8.

A cover detector 2C that detects opening and closing of the access cover 11 is also disposed to the printer cabinet 2. The cover detector 2C is a contact sensor disposed to an edge of the opening 2B in this example. A different type of sensor can obviously be used as the cover detector 2C. For example, because the access cover 11 opens on a pivot axis at one end, a sensor that detects rotation of the access cover 11 may be disposed to this axis.

Media Conveyance Path and Conveyance Mechanism

As shown in FIG. 2, a paper supply path 12, device-side conveyance path 13, and reversing conveyance path 14 are formed inside the printer 1. The paper supply path 12 and device-side conveyance path 13 are formed inside the printer cabinet 2, and the reversing conveyance path 14 is formed inside the reversing unit 3.

The paper supply path 12 is a conveyance path that conveys paper P stored in a stack in the paper cassette 6 to the device-side conveyance path 13. The paper supply path 12 extends diagonally up from the back end of the paper cassette loading unit 5 on the longitudinal axis Y, curves toward the front, and connects to the device-side conveyance path 13. Paper P stored in the paper cassette 6 is fed by a paper feed roller 15 to the paper supply path 12. The supplied paper is fed one sheet at a time through the nipping part of a conveyance roller 17 and a retard roller 16, and is conveyed through the nipping part of the conveyance roller 17 and a follower roller 18 to the device-side conveyance path 13.

The device-side conveyance path 13 is the conveyance path extending substantially horizontally along the longitudinal axis Y to the paper exit 8. Disposed along the device-side conveyance path 13 in order from the upstream side in the paper conveyance direction are the detection lever of a paper detector 20, a paper feed roller pair 21 (conveyance roller pair), a printhead 22 (recording head), a first discharge roller pair 23, and a second discharge roller pair 24. The printhead 22 is an inkjet head and has a nozzle face 22*a* in which the ink nozzles are formed.

A platen 25 is disposed opposite the nozzle face 22*a* with a specific gap therebetween. When the paper P passes the detection position of the detection lever, the detection lever moves and the paper detector 20 detects passage of the paper P.

The paper feed roller pair 21 includes a paper feed roller 21*a* and a driven roller 21*b*. Paper fed from the paper supply path 12 to the device-side conveyance path 13 is conveyed by the conveyance roller 17 to the paper feed roller pair 21 while pushing up on the detection lever of the paper detector 20, passes between the paper feed roller 21*a* and driven roller 21*b* and is supplied to the printing position between the printhead 22 and platen 25. A friction layer of dispersed inorganic particles is formed on the surface of the paper feed roller 21*a*.

The first discharge roller pair 23 includes a first discharge roller 23*a* and a driven roller 23*b*, and the second discharge roller pair 24 includes a second discharge roller 24*a* and a driven roller 24*b*. After the paper passes the printing position, the paper is conveyed between the first discharge roller 23*a* and driven roller 23*b* and between the second discharge roller 24*a* and driven roller 24*b*, and is discharged from the paper exit 8 onto the paper discharge tray 7.

The paper feed roller pair 21, the first discharge roller pair 23, and the second discharge roller pair 24 can be switched between a nipping position holding the paper P between the rollers, and a release position with the rollers separated from each other. The release operation of the three sets of roller pairs is coordinated with the platen gap adjustment operation of the platen gap adjustment mechanism 70 described below.

Figure 3:
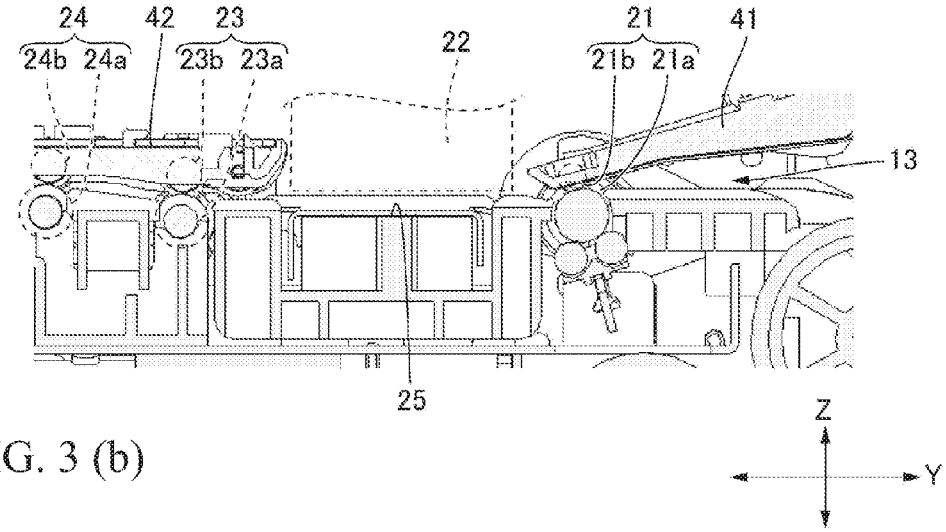
FIGS. 3(*a*) and 3(*b*) show an enlarged view of part of the device-side conveyance path.
Figure 3:
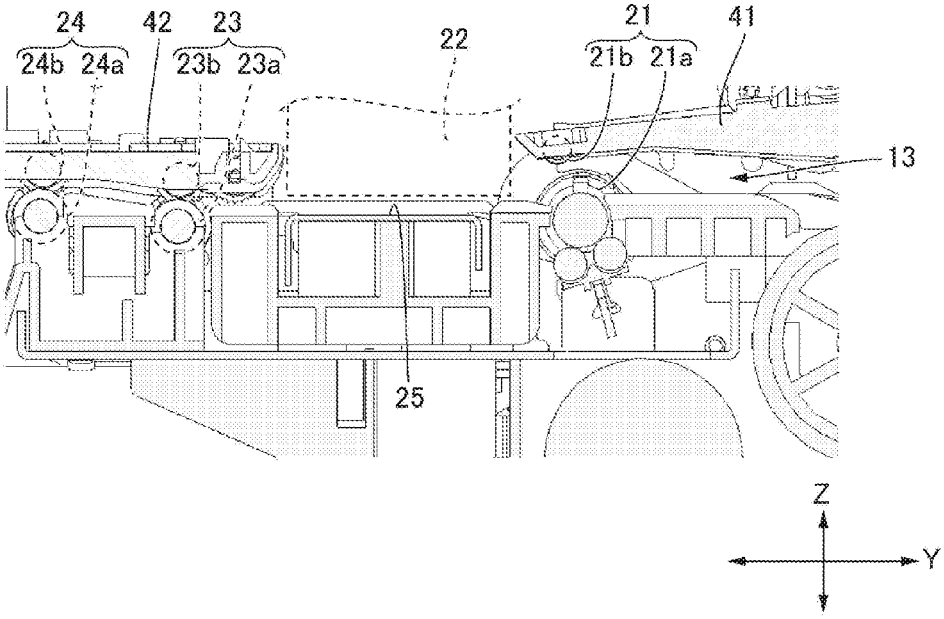

FIG. 3 is an enlarged view of part of the device-side conveyance path 13, FIG. 3(*a*) showing the paper feed roller pair 21 in the nipping position, and FIG. 3(*b*) showing the paper feed roller pair 21 in the release position. The driven roller 21*b* of the paper feed roller pair 21 is located on the upstream side of the printhead 22 (the side toward the back of the printer) at the front end of a first roller frame 41.

The first roller frame 41 is disposed above the device-side conveyance path 13 and is supported to pivot on the vertical axis Z. The first roller frame 41 is urged by an urging member not shown in the direction pushing the driven roller 21*b* to the paper feed roller 21*a*. The first roller frame 41, as described further below, tilts in the direction moving the driven roller 21*b* away from the paper feed roller 21*a* in conjunction with the platen gap adjustment operation. As a result, the paper feed roller pair 21 goes to the release position shown in FIG. 3(*b*).

The driven rollers 23*b*, 24*b* of the first and second discharge roller pairs 23, 24 are mounted on a second roller frame 42 on the downstream side of the printhead 22 (the side toward the front of the printer). The second roller frame 42 is supported to move on the vertical axis Z, and is urged by an urging member not shown in the direction (towards the bottom of the printer) pushing the driven rollers 23*b*, 24*b* to the first and second discharge rollers 23*a*, 24*a*. As described further below, the second roller frame 42 moves the driven rollers 23*b*, 24*b* in the direction away from the first and second discharge rollers 23*a*, 24*a* (towards the top of the printer) in conjunction with the platen gap adjustment operation The reversing conveyance path 14 formed inside the reversing unit 3 is located below the device-side conveyance path 13 on the vertical axis Z, and is a conveyance path that generally forms a loop. The reversing conveyance path 14 includes an upstream path 26 that connects to the upstream end of the device-side conveyance path 13 and extends substantially horizontally to the back on the longitudinal axis Y, a descending path 27 that curves and extends down in a straight line on the vertical axis Z from the upstream path 26, a bottom path 28 that connects to the descending path 27 and curves to the front on the longitudinal axis Y, and an ascending path 29 that curves and extends upward from the bottom path 28.

The top part of the ascending path 29 curves at an angle to the printer front, and merges with the paper supply path 12 in the middle. The ascending path 29 and the downstream part of the paper supply path 12 therefore share a common path. This common path is a curved path extending along the outside of the conveyance roller 17.

A first conveyance roller 31 and a follower roller 32 are disposed between the upstream path 26 and the descending path 27, and a second conveyance roller 33 and a follower roller 34 are disposed between the bottom path 28 and the ascending path 29. Paper conveyed from the device-side conveyance path 13 to the reversing conveyance path 14 is nipped by the first conveyance roller 31 and follower roller 32, then conveyed by the first conveyance roller 31 to the nipping part of the second conveyance roller 33 and follower roller 34, and then conveyed by the second conveyance roller 33 to the nipping part of the conveyance roller 17 and follower roller 18. The paper is then fed by the conveyance roller 17 to the device-side conveyance path 13 again.

A path-changing flapper 36 is disposed at the junction 35 of the upstream end of the device-side conveyance path 13, the upstream end of the reversing conveyance path 14, and the downstream end of the paper supply path 12. When paper P is reversed from the device-side conveyance path 13 side, the paper P is guided by the path-changing flapper 36 to the reversing conveyance path 14. When the paper then passes through the reversing conveyance path 14 and returns to the junction 35, the front and back of the paper P are reversed. Because the paper P returned to the junction 35 from the reversing conveyance path 14 pushes the path-changing flapper 36 is up, the downstream end of the reversing conveyance path 14 communicates with the device-side conveyance path 13, and the paper P is fed into the device-side conveyance path 13. Because the reversing conveyance path 14 forms a loop, the paper P is thus returned to the device-side conveyance path 13 with the front and back of the paper P reversed. Duplex printing on the paper P is thus possible by passing the paper P through the reversing conveyance path 14.

Print Mechanism Unit

Figure 4:
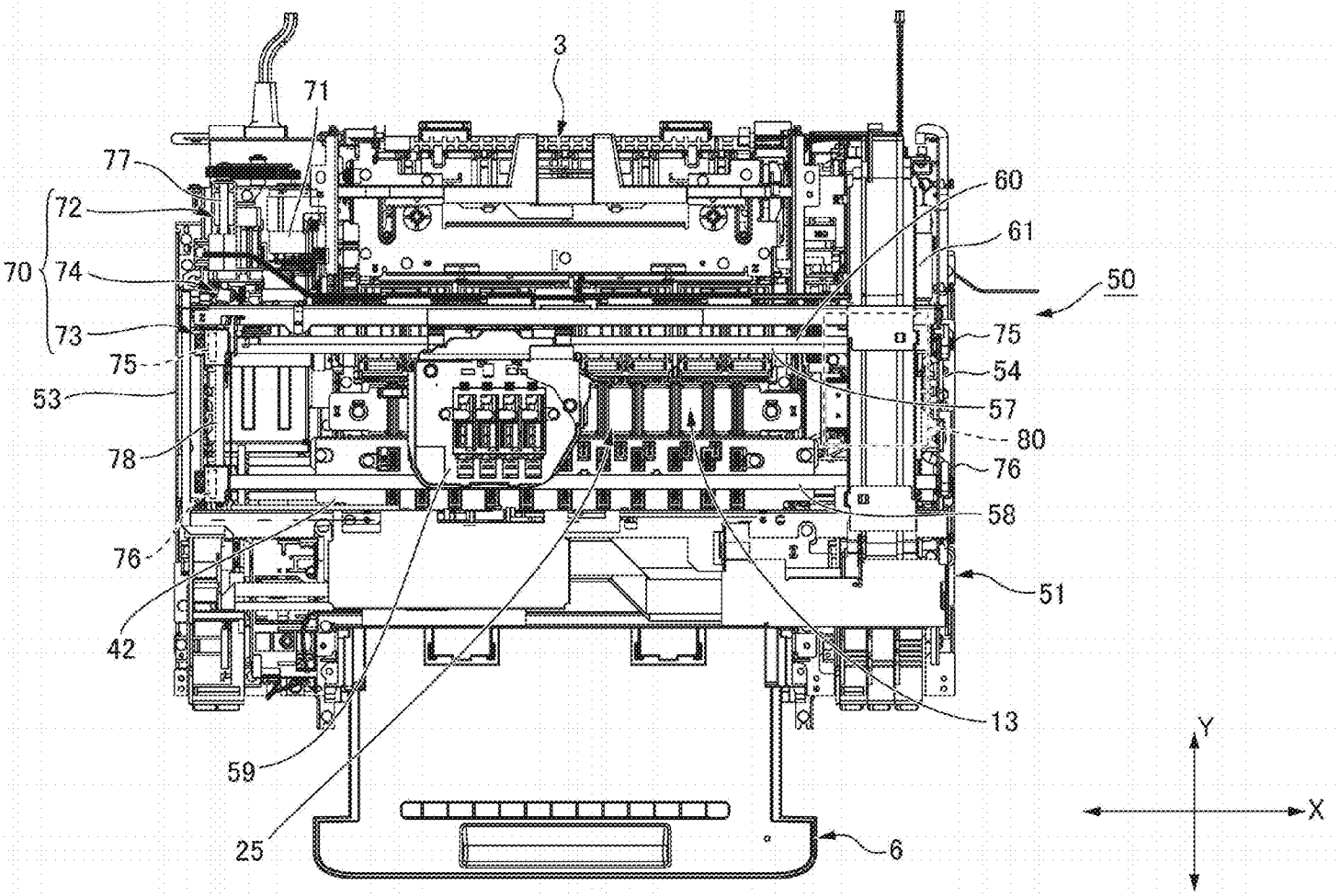
FIG. 4 is a plan view of the print mechanism.
Figure 5:
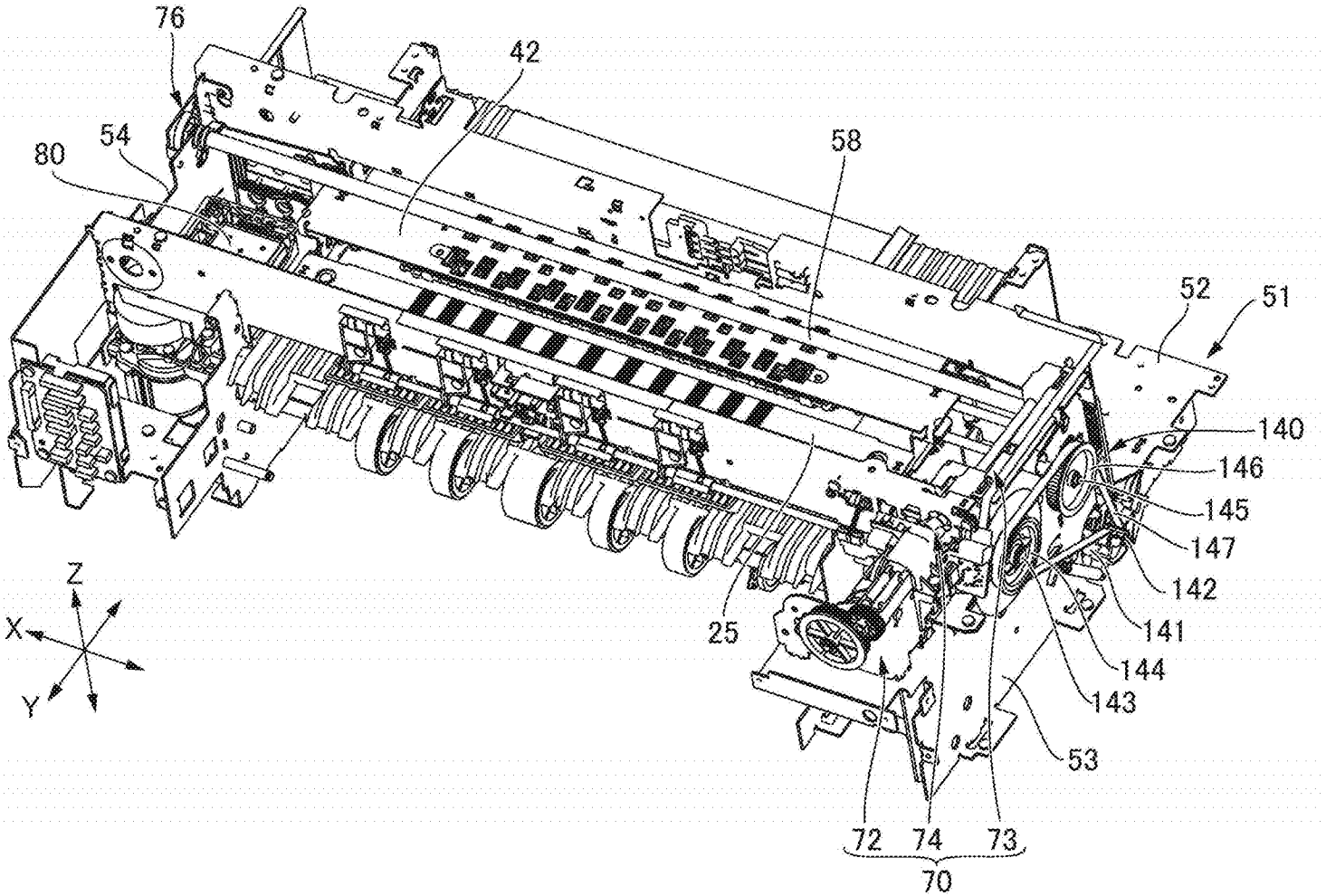
FIG. 5 is an oblique view from the back showing a main part of the print mechanism.

FIG. 4 is a plan view of the print mechanism unit that is housed inside the main case 2A of the printer 1, and shows the print mechanism unit with the main case 2A and paper discharge tray 7 removed. FIG. 5 is an oblique view of the main part of the print mechanism unit from the back of the printer on the longitudinal axis Y.

The print mechanism unit 50 includes a sheet metal print unit frame 51, and the components of the print mechanism unit 50 are assembled on the print unit frame 51. The print unit frame 51 includes a base frame 52 (FIG. 5) at the bottom of the print mechanism unit 50, and side frames 53, 54 rising perpendicularly from the base frame 52 at positions on opposite sides on the transverse axis X.

Two carriage guide rails 57, 58 extend parallel to the transverse axis X between the side frames 53, 54. A head carriage 59 is mounted on the carriage guide rails 57, 58. The head carriage 59 can move on the transverse axis X along the carriage guide rails 57, 58. The head carriage 59 is connected to a timing belt 60 extending on the transverse axis X at a position near the guide rail 57 that is closer to the back of the printer. The timing belt 60 is mounted on a pair of pulleys, and is driven by a carriage drive motor 61 through the pulleys.

The timing belt 60, pair of pulleys, and the carriage drive motor 61 embody the carriage drive mechanism that moves the head carriage 59 reciprocally on the transverse axis X.

The printhead 22 is mounted on the head carriage 59. The printhead 22 is an inkjet head, and is disposed with the nozzle face 22*a* (FIG. 2) in which the ink nozzles are formed facing the bottom of the printer. A platen 25 is disposed below the printhead 22.

The paper P is conveyed on the longitudinal axis Y over the surface of the platen 25. The printhead 22 moves on the transverse axis X along the carriage guide rails 57, 58, and is positioned above the paper P conveyed over the surface of the platen 25. The printhead 22 prints by ejecting ink onto the paper P from the ink nozzles formed in the nozzle face 22*a*.

As shown in FIG. 5, the power transfer mechanism 140 of the conveyance roller pairs (paper feed roller pair 21 and first discharge roller pair 23) that convey the paper P through the device-side conveyance path 13 is assembled on the side frame 53 on the outside side on the transverse axis X.

A paper feed motor 141 is mounted on the base frame 52 side of the side frame 53. The ends 143, 145 of the roller shafts of the paper feed roller 21*a*, which is the drive roller of the paper feed roller pair 21, and the first discharge roller 23*a*, which is the drive roller of the first discharge roller pair 23, are supported freely rotatably by the side frame 53. The ends 143, 145 protrude from the side frame 53 to the outside on the transverse axis X, and transfer gears 144, 146 are affixed coaxially to the ends 143, 145. Rotation from the paper feed motor 141 is transferred to the paper feed roller 21*a* and first discharge roller 23*a* through the timing belt 147 mounted on the transfer gears 144, 146 and a pinion 142 affixed to the distal end of the paper feed motor 141 shaft.

A platen gap adjustment mechanism 70 for adjusting the gap (platen gap) between the printhead 22 and platen 25 is disposed to the side frame 53 on the inside on the transverse axis X. The platen gap is the distance from the nozzle face 22*a* of the printhead 22 to the surface of the platen 25, or the distance from the nozzle face 22*a* to the printing surface of the paper P conveyed over the platen 25. The platen gap adjustment mechanism 70 moves the two carriage guide rails 57, 58 located above the platen 25 on the vertical axis Z, and thereby moves the printhead 22 carried on the head carriage 59 on the vertical axis Z and increases or decreases the platen gap.

The platen gap adjustment mechanism 70 includes a stationary-side unit 72 to which a gap adjustment motor 71 and other stationary-side components mounted on the print unit frame 51 side are disposed; a movable-side unit 73 to which movable-side components that can move on the vertical axis Z in unison with the carriage guide rails 57, 58 are disposed; a universal joint unit 74 that transfers torque from the stationary-side unit 72 to the movable-side unit 73; and rotary cam mechanisms 75, 76.

The stationary-side unit 72 includes a stationary-side rotary shaft 77 that transfers torque from the gap adjustment motor 71 to the stationary-side universal joint part of the universal joint unit 74.

The movable-side unit 73 has a movable-side rotary shaft 78, which is a rotation transfer member for synchronously turning the two carriage guide rails 57, 58. The movable-side rotary shaft 78 is connected to the movable-side universal joint part of the universal joint unit 74. The stationary-side rotary shaft 77 and the movable-side rotary shaft 78 extend on the longitudinal axis Y.

A rotary cam mechanism 75 is disposed to each end of carriage guide rail 57, and a rotary cam mechanism 76 is disposed to each end of carriage guide rail 58. The rotary cam mechanism 75 is a conversion mechanism that converts rotation of the carriage guide rail 57 to movement of the carriage guide rail 57 on the vertical axis Z (in the gap adjustment direction). Rotary cam mechanism 58 is likewise a conversion mechanism that converts rotation of the carriage guide rail 58 to movement of the carriage guide rail 58 on the vertical axis Z (in the gap adjustment direction).

When the carriage guide rails 57, 58 turn synchronously, the rotary cam mechanisms 75, 76 turn in the same phase of rotation. As a result, the movable-side unit 73 and the carriage guide rails 57, 58 move synchronously on the vertical axis Z while maintaining the same posture. As a result, the printhead 22 on the movable side moves on the vertical axis Z relative to the platen 25 on the stationary side while maintaining the same posture and the platen gap is adjusted.

As described above, the printer 1 has a mechanism that opens the conveyance roller pair that conveys the paper P through the device-side conveyance path 13 and releases the paper in conjunction with the platen gap adjustment operation of the platen gap adjustment mechanism 70. This mechanism is a mechanism that tilts the first roller frame 41 and opens (releases) the paper feed roller pair 21 based on rotation of the carriage guide rail 57, and a mechanism that moves the second roller frame 42 up and opens (releases) the first and second discharge roller pairs 23, 24 based on rotation of the carriage guide rail 58.

Carriage Operation

Figure 6:
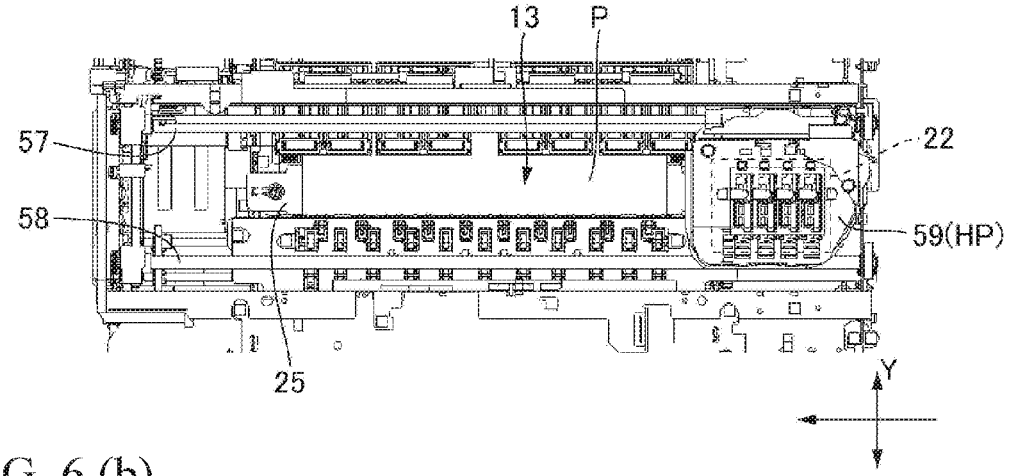
FIGS. 6(*a*), 6(*b*) and 6(*c*) illustrate the range of head carriage and printhead movement.
Figure 6:
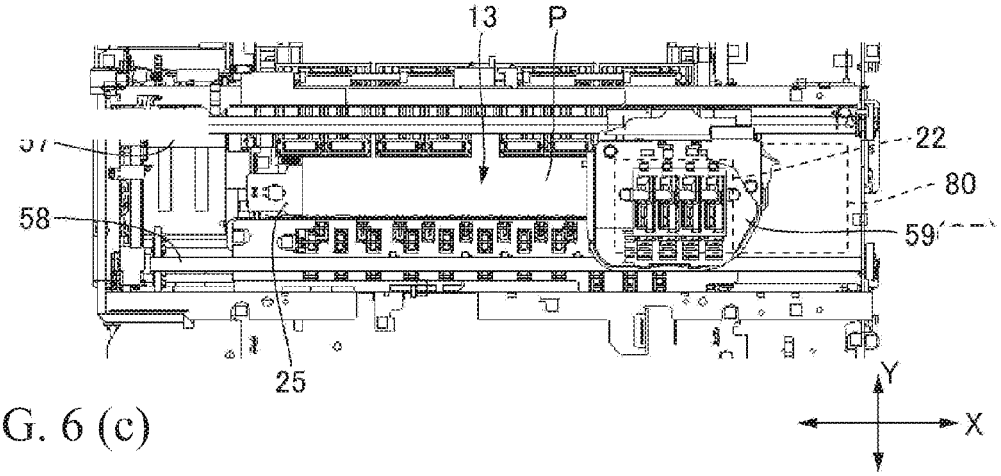
Figure 6:
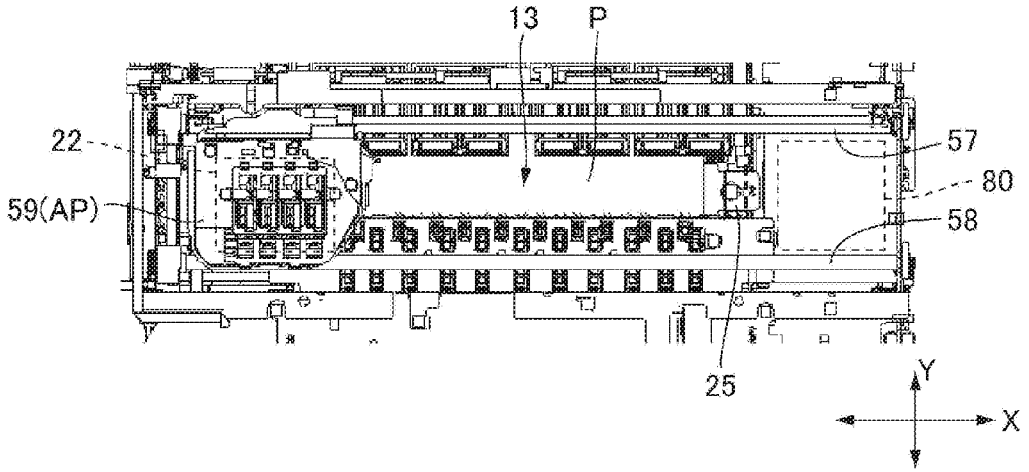

FIG. 6 illustrates the range of movement of the head carriage 59 and printhead 22. FIG. 6(*a*) shows the home position HP at one end of the movement range; FIG. 6(*b*) shows the home-side retracted position OP, which is a position to which the printhead 22 moves away from the paper P on the home position HP side; and FIG. 6(*c*) shows the away position AP, which is a position at the other end of the movement range.

The head carriage 59 carrying the printhead 22 can move bidirectionally by means of the carriage drive mechanism described above in a direction (on the transverse axis X) perpendicular to the conveyance direction (the longitudinal axis Y) of the paper P through the device-side conveyance path 13. The range of movement of the printhead 22 and head carriage 59 is the range from the home position HP between the platen 25 and the one side frame 54 and the away position AP (second retracted position) between the platen 25 and the other side frame 53.

The home position HP is the standby position where the printhead 22 waits when not printing. A maintenance unit 80 is disposed at the bottom of the printer at the home position HP. the maintenance unit 80 includes a head cap that opposes the nozzle face 22*a* when the printhead 22 is at the home position HP, a lift mechanism that moves the head cap up and down, and a suction pump that suctions ink from inside the head cap. The maintenance unit 80 raises the head cap and caps the nozzle face 22*a* when the printhead 22 is at the home position HP. Maintenance such as suctioning ink from the ink nozzles can performed when the nozzle face 22*a* is capped by the head cap.

As shown in FIG. 6(*a*), the paper P conveyed through the device-side conveyance path 13 travels over the middle of the platen 25 on the transverse axis X. When the printhead 22 moves from over the paper P to the h printer, the printhead 22 passes through the home-side retracted position OP (first retracted position) shown in FIG. 6(*b*) to the home position HP. The home-side retracted position OP is the position immediately after the printhead 22 is completely removed from over the paper P. The home position HP is further to the outside from the home-side retracted position OP on the transverse axis X.

At the home position HP, the head carriage 59 is completely removed from over the paper P.

The away position AP shown in FIG. 6(*c*) is a position on the opposite side of the paper P as the home-side retracted position OP where the printhead 22 is completely removed from over the paper P.

The printer 1 in this example is a serial head printer having a printhead 22 that is smaller than the width of the paper P and prints to the full width of the paper P by moving the printhead 22 bidirectionally on the transverse axis X. The control unit of the printer 1 moves the head carriage 59 at a predetermined reference speed V0 when printing. When a paper jam occurs on the device-side conveyance path 13, the control unit of the printer 1 retracts the head carriage 59 from over the paper P. The initial retraction speed V1 applied when this retraction operation starts is slower than the reference speed V0.

The initial retraction speed V1 is a speed at which there is a low probability of the head carriage 59 and printhead 22 pulling and tearing the paper P, or causing the paper P to jam further so that the carriage drive motor 61 is overloaded and stops, when the head carriage 59 and printhead 22 are moved after a paper jam occurs. The initial retraction speed V1 is 5 ips (inch/second) in this example. As described below, the retraction speed of the head carriage 59 when retraction starts is initial retraction speed V1, and changes to a high retraction speed V2 that is faster than the initial retraction speed V1 depending on the opened or closed state of the access cover 11. The high retraction speed V2 in this example is 40 ips, that is, eight times the initial retraction speed V1. The high retraction speed V2 can be set to a speed that can control the time required for the retraction operation to a desired time (such as 5 s or less in this example). Note that the speeds described above are for example only, and different speeds may obviously be used.

Figure 7:
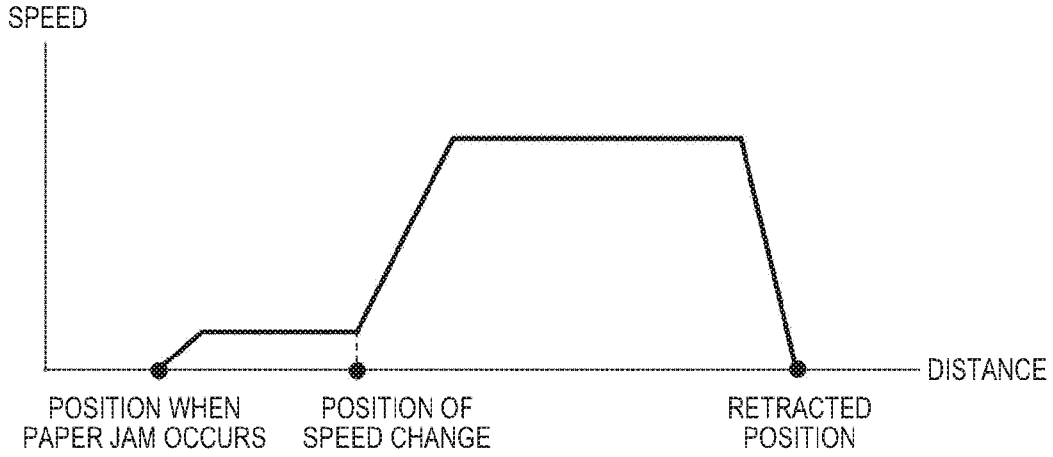
FIGS. 7(*a*), 7(*b*) and 7(*c*) describe an example of a speed profile used for speed control of the head carriage.
Figure 7:
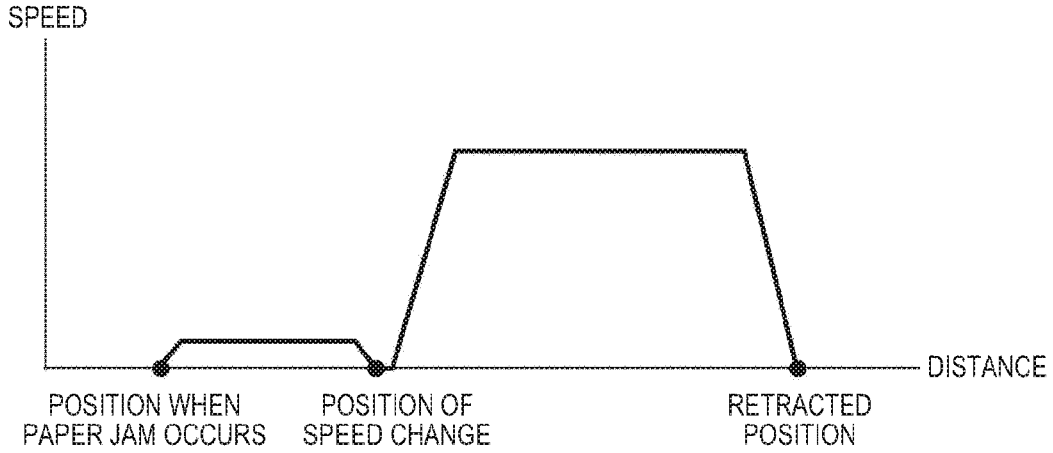
Figure 7:
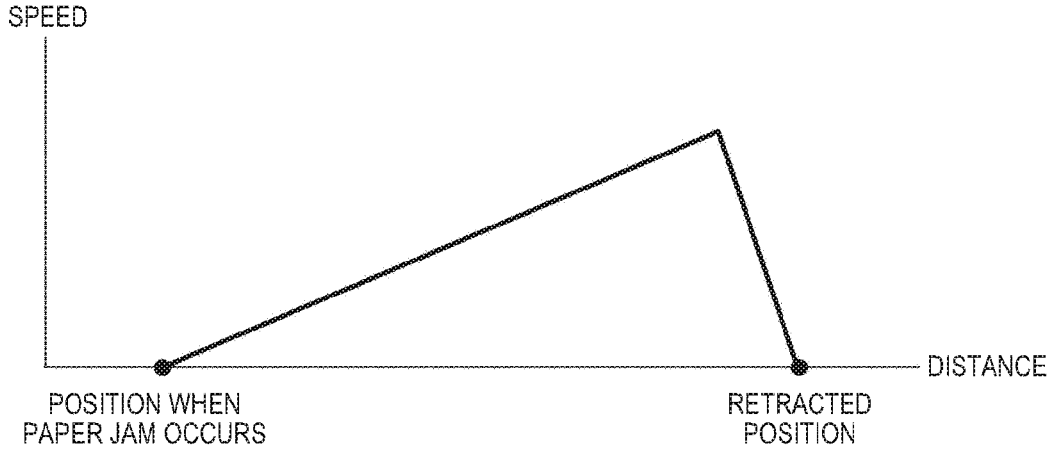

FIG. 7 shows an example of a speed profile used for speed control of the head carriage 59. FIG. 7(*a*) is a speed profile used to change the speed without stopping the head carriage 59, FIG. 7(*b*) is a speed profile that pauses the head carriage 59 to change the speed. The retraction speed can also be controlled using a speed profile such as shown in FIG. 7(*c*).

The speed profile in FIG. 7(*c*) is a speed profile that increases the retraction speed at a constant acceleration rate from when retraction starts, and then decreases the retraction speed at a constant acceleration rate to stop at the retracted position.

These speed profiles are stored in the control unit of the printer 1. To retract the head carriage 59, the required speed profile is read, and driving the carriage drive motor 61 is controlled by PID control based on the speed profile.

Control when a Paper Jam Occurs

When a paper jam occurs in the printer, the control unit of the printer 1 detects the paper jam based on the drive load of the motor that drives the conveyance roller pair conveying the paper P, or output from sensors that detect the paper P, for example. For example, when paper P is conveyed in the device-side conveyance path 13, whether or not a paper jam occurred can be detected base on the drive load of the paper feed motor 141 or output from the paper detector 20. A paper jam can also be detected based on the drive load of the carriage drive motor 61.

Figure 8:
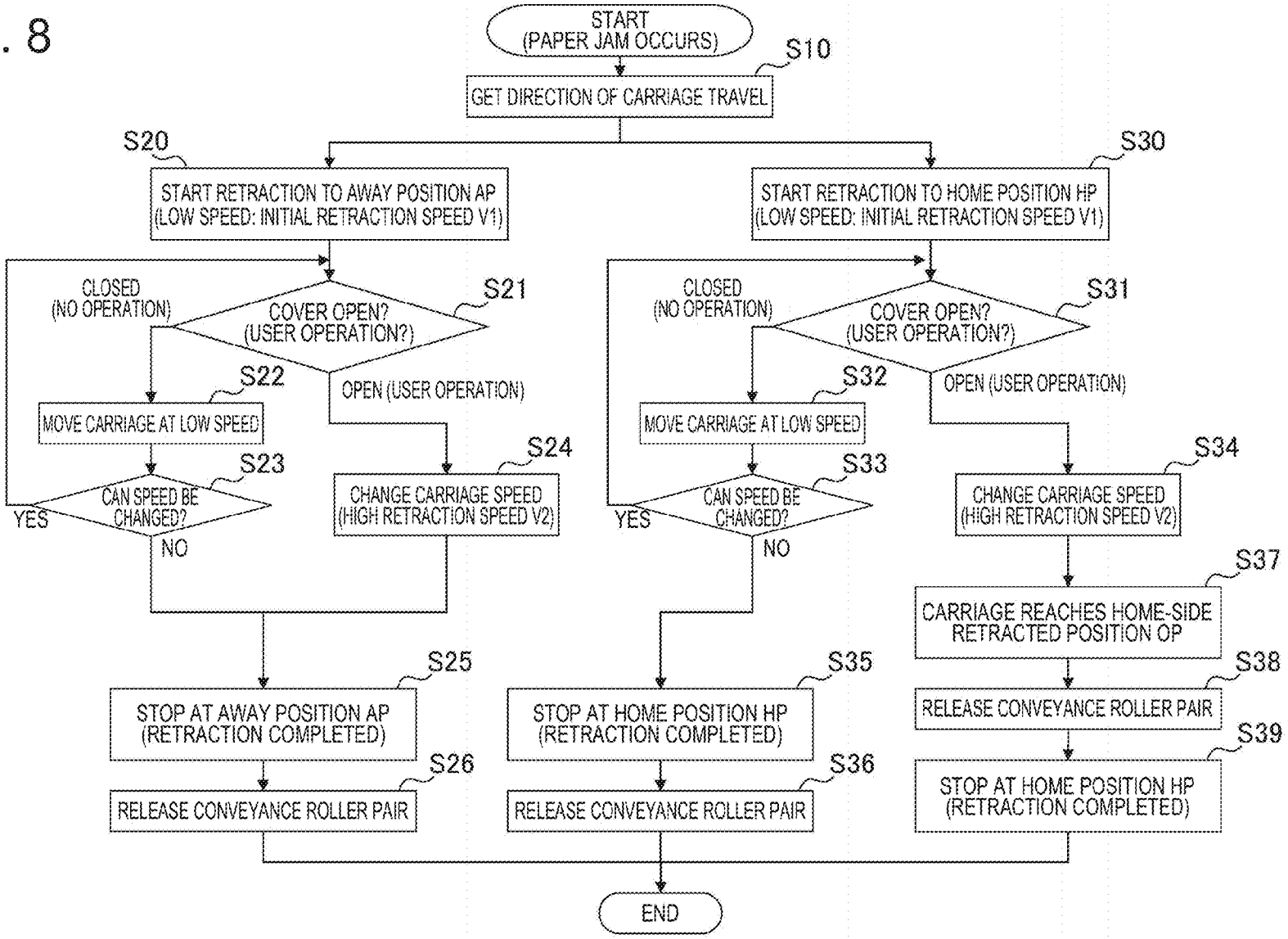
FIG. 8 is a flow chart of printer control when a paper jam occurs.

FIG. 8 is a flow chart describing control of the printer 1 when paper jam occurs. The control unit of the printer 1 monitors at least one of the drive load of the paper feed motor 141, the output of the paper detector 20, and the drive load of the carriage drive motor 61, and detects if a paper jam occurred based on the monitored parameter. If the control unit of the printer 1 detects that a paper jam occurred on the device-side conveyance path 13 when the printhead 22 is moving over the paper P while printing, the control unit starts the control process in FIG. 8 to retract the printhead 22 so that the jammed paper P can be easily removed.

If a paper jam is detected while printing, the control unit of the printer 1 first gets the direction the head carriage 59 was travelling in step S10. More specifically, the control unit of the printer 1 determines if the head carriage 59 was moving to the away position AP side or was moving to the home position HP side.

If the head carriage 59 was moving toward the away position AP, the control unit goes to step S20 and starts retracting the printhead 22 to the retracted position on the away position AP side. In step S20, the control unit changes the speed of head carriage 59 movement to the initial retraction speed V1, which is lower than the reference speed V0, and starts retraction at a slow speed. Control then goes to step S21.

If the head carriage 59 was moving toward the home position HP, the control unit goes to step S30 and starts retracting the printhead 22 to the retracted position on the home position HP side. As when retracting the printhead 22 to the away position AP side, the control unit changes the speed of head carriage 59 movement to the initial retraction speed V1, which is lower than the reference speed V0, in step S30 and starts retraction at a slow speed. Control then goes to step S31.

In steps S21 to S23, the control unit of the printer 1 moves the head carriage 59 at the initial retraction speed V1 toward the away position AP while monitoring the output of the cover detector 2C. As described above, the cover detector 2C is a sensor that detects if the access cover 11, which opens and closes the device-side conveyance path 13, is open or closed. In other words, in steps S21 to S23, the control unit controls moving the head carriage 59 at a low speed toward the away position AP while monitoring if the user opened the access cover 11.

After changing the speed of the head carriage 59 to the initial retraction speed V1 in step S20, the control unit of the printer 1 first determines based on the output of the cover detector 2C if the access cover 11 was opened (step S21). If the access cover 11 was not opened (step S21: No), control goes to step S22. In step S22, the control unit drives the head carriage 59 a specific amount toward the away position AP at the initial retraction speed V1. Next, control goes to step S23, and the control unit determines if the speed of the head carriage 59 can be changed. If the speed can be changed (step S23: Yes), control returns to step S21. Steps S21 to S23 then repeat.

If in step S23 the control unit determines the speed of the head carriage 59 cannot be changed (step S23: No), it continues retracting the printhead 22 at the low initial retraction speed V1 until the head carriage 59 reaches the away position AP. Note that the decision of step S23 also considers the control content for changing the speed of the head carriage 59, and may be omitted depending on the control method of the carriage drive motor 61, for example.

If the control unit determines in step S21 that the access cover 11 was opened (step S21: Yes), control goes to step S24. In step S24, the control unit changes the speed of the head carriage 59 from the initial retraction speed V1 to the faster high retraction speed V2, and continues retraction to the away position AP side. When control goes to step S24, the speed is thereafter changed, and retraction of the head carriage 59 at the high retraction speed V2 continues until the head carriage 59 reaches the away position AP.

When the head carriage 59 reaches the away position AP, the head carriage 59 stops (step S25), and the control unit opens (releases) the conveyance roller pair (step S26). In step S26, the control unit drives the gap adjustment motor 71 of the platen gap adjustment mechanism 70. As a result, the first and second roller frames 41, 42 move synchronously in conjunction with the platen gap adjustment operation, and the paper feed roller pair 21 and the first and second discharge roller pairs 23, 24 release the paper P.

As described above, the speed is immediately changed to the high retraction speed V2 if the access cover 11 is opened while the head carriage 59 is being retracted to the away position AP, but the speed remains unchanged at the initial retraction speed V1 if the access cover 11 is not opened. The head carriage 59 stops when it reaches the away position AP, and the conveyance roller pair is then opened to the release position. As a result, retracting the head carriage 59 and releasing the conveyance roller pair is completed, and paper P stuck in the device-side conveyance path 13 can be easily removed.

When retracting the head carriage 59 to the home position HP side, the same control applied in steps S21 to S24 is applied in steps S31 to S34. More specifically, in steps S31 to S33, the control unit monitors the output of the cover detector 2C and if the access cover 11 is not opened (step S31: No), continues moving the head carriage 59 at the initial retraction speed V1 to the home position HP side. If the access cover 11 is opened (step S31: Yes), control goes to step S34, the speed of the head carriage 59 changes from the initial retraction speed V1 to the high retraction speed V2, and retraction to the home position HP continues.

The head carriage 59 reaches the home-side retracted position OP before reaching the home position HP. If the head carriage 59 reaches the home-side retracted position OP at the initial retraction speed V1 without the access cover 11 opening, there is no need to consider the risk of the user pulling on the paper P before the head carriage 59 is completely retracted. Retraction therefore continues at the initial retraction speed V1 in this situation. As a result, the head carriage 59 reaches the home position HP at the initial retraction speed V1 and stops (step S35). The conveyance roller pair is then released after the head carriage 59 reaches the home position HP (step S36).

However, if opening the access cover 11 is detected and the retraction speed of the head carriage 59 is changed to the high retraction speed V2 (step S34), the head carriage 59 reaches the home-side retracted position OP at the high retraction speed V2 (step S37).

In this event, there is a risk of the user pulling on the paper P before the head carriage 59 is completely retracted, and the conveyance roller pair is opened (released) as soon as the head carriage 59 reaches the home-side retracted position OP (step S38). As a result, the conveyance roller pair is released immediately after the printhead 22 is removed from over the paper P, and paper P stuck in the device-side conveyance path 13 can be easily removed. Retracting the head carriage 59 at the high retraction speed V2 then continues, and the head carriage 59 is stopped at the home position HP (step S39).

EFFECT OF THE INVENTION

As described above, the printer 1 according to this embodiment of the invention starts moving the head carriage 59 at a initial retraction speed V1 to retract the head carriage 59 carrying the printhead 22 to a position away from the paper P when a paper jam occurs. The printer 1 increases the speed of the head carriage 59 and retracts the head carriage 59 at the high retraction speed V2 only if the access cover 11 that covers the opening 2B of the main case 2A is detected to open while the head carriage 59 is being retracted. As a result, because the initial retraction speed V1 is slow, unless the access cover 11 is opened by the user, there is little chance of the moving head carriage 59 and printhead 22 pulling the paper P in the direction of travel and worsening the paper jam.

Because the head carriage 59 is retracted at a high speed if the access cover 11 is opened by the user, there is also little chance of a user that wants to quickly resume printer 1 operation pulling on the paper P and the paper P catching on the printhead 22 or head carriage 59 and tearing before the head carriage 59 is completely retracted. There is therefore also little chance of problems resulting from torn pieces of paper being left inside the printer.

This embodiment of the invention makes removing jammed paper P easy by retracting the printhead 22 from over the paper P and opening the conveyance roller pair, and preferably quickly creates a condition enabling easily removing the paper P if the access cover 11 is opened. If the conveyance roller pair is released before the printhead 22 is completely retracted from over the paper P, the paper P can easily separate from the platen and catch on the printhead 22, and the paper jam may be made worse. Therefore, if the access cover 11 is opened while the head carriage 59 is retracting to the home position HP side, the conveyance roller pair is released as soon as the printhead 22 moves away from the paper P (as soon as the printhead 22 reaches the home-side retracted position OP) without waiting to retract completely to the home position HP. As a result, stuck paper P can be easily removed as soon as possible, and the chance of the paper P being torn can be reduced.

When the head carriage 59 retracts to the away position AP side, the conveyance roller pair is released as soon as the head carriage 59 reaches the away position AP regardless of whether the access cover 11 was opened. As a result, stuck paper P can be easily and quickly removed when the head carriage 59 retracts to the opposite side as the home position HP.

The embodiment described above determines the direction of head carriage 59 movement in step S10, and makes the detected direction of travel the retraction direction. Alternatively, the direction of travel and the current position of the head carriage 59 may be detected in step S10, and the retraction direction determined based on the direction of travel and the current position. For example, if the current position is closer to the home position HP than the away position AP, the target retraction position may be set to the home position HP and the retraction direction set to the direction toward the home position HP.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A recording device comprising:

a conveyance roller pair that conveys a recording medium;

a recording head that records on the recording medium;

a carriage that carries the recording head;

a carriage drive mechanism that moves the carriage crosswise to the conveyance direction of the recording medium;

a control unit that, when a paper jam of the recording medium is detected, retracts the carriage to one end or the other end of the carriage movement range at a predetermined initial retraction speed, and when a paper jam of the recording medium is not detected, does not retract the carriage at the predetermined initial retraction speed;

an access cover that covers the conveyance path through which the recording medium is conveyed; and a detector that detects opening the access cover, wherein the control unit changes the speed of carriage movement to a faster speed than the initial retraction speed based on the detector detecting opening of the access cover.

2. The recording device described in claim 1, wherein:

one end of the carriage movement range is a position further removed from the recording medium than a position where the recording head is removed from the recording medium; and the control unit is configured to change the timing of opening the conveyance roller pair according to whether or not the detector detecting opening of the access cover when moving the carriage toward the one end.

3. The recording device described in claim 2, wherein:

when moving the carriage toward the one end, the control unit is configured to open the conveyance roller pair timed to the recording head reaching a first retracted position separated from the recording medium on the same side as the one end if the detector detects opening of the access cover, and open the conveyance roller pair timed to the recording head passing the first retracted position and reaching the one end if the detector does not detect opening of the access cover.

4. The recording device described in claim 3, wherein:

the carriage movement range includes the one end, and a second retracted position where the recording head is separated from the recording medium on the opposite side as the one end; and when moving the carriage toward the opposite side as the one end, the control unit is configured to open the conveyance roller pair timed to the recording head reaching the second retracted position whether or not the detector detects opening of the access cover.

5. The recording device described in claim 1, wherein:

the recording head is an inkjet head; and the one end of the carriage movement range is a position where the inkjet head opposes a head cap that caps the nozzle face of the inkjet head.

* * * * *